US012018551B2

(12) United States Patent
Murdoch et al.

(10) Patent No.: US 12,018,551 B2
(45) Date of Patent: Jun. 25, 2024

(54) COMPACT LUBRICATOR AND HEADER SYSTEM

(71) Applicant: TIER 1 ENERGY TECH, INC., Edmonton (CA)

(72) Inventors: Scott Murdoch, Calgary (CA); Watcharin Suttipisetchart, Calgary (CA); Stephen Vetter, Sylvan Lake (CA); Leigh Durling, Calgary (CA)

( * ) Notice: Subject to any disclaimer, the term of this patent is extended or adjusted under 35 U.S.C. 154(b) by 0 days.

(21) Appl. No.: 17/532,812

(22) Filed: Nov. 22, 2021

(65) Prior Publication Data

US 2022/0082000 A1 Mar. 17, 2022

Related U.S. Application Data

(63) Continuation of application No. 16/260,719, filed on Jan. 29, 2019, now Pat. No. 11,208,874.

(60) Provisional application No. 62/623,390, filed on Jan. 29, 2018.

(51) Int. Cl.

| | |
|---|---|
| ***E21B 43/12*** | (2006.01) |
| ***E21B 23/12*** | (2006.01) |
| ***E21B 33/068*** | (2006.01) |

(52) U.S. Cl.

CPC ..... *E21B 43/12* (2013.01); *E21B 23/12* (2020.05); *E21B 33/068* (2013.01)

(58) Field of Classification Search

CPC ..... E21B 43/12; E21B 23/12; E21B 33/068

See application file for complete search history.

(56) References Cited

U.S. PATENT DOCUMENTS

| | | | | |
|---|---|---|---|---|
| 2,573,177 | A * | 10/1951 | Bohlen | F16K 27/107 251/315.15 |
| 2015/0176377 | A1* | 6/2015 | Agarwal | E21B 17/07 166/372 |
| 2016/0097265 | A1* | 4/2016 | Bishop | E21B 43/121 166/372 |

* cited by examiner

*Primary Examiner* — Patrick C Williams

(74) *Attorney, Agent, or Firm* — Bennett Jones LLP

(57) ABSTRACT

A header with associated lubricator is for fluid handling at the wellhead of an oil and gas well where a plunger/lubricator lift system is deployed, and provides a novel compact lubricator with attached header which can replace a conventional wellhead flow-tee without modifying or moving other wellhead equipment to accommodate the new lubricator and header replacing the old flow-tee. A sub seal is provided at the header/lubricator attachment(s). The header with associated lubricator encloses a conduit with seals in the attachment interfaces between the header and lubricator or between the header and exit attachment means, where the conduit may also comprise a means of flow restriction through machined geometry or by retaining a reduced diameter or valve component through various means of attachment. The flow restrictor means may also be serviced via service access means provided in the header or lubricator exterior wall.

13 Claims, 10 Drawing Sheets

20
20
4C
4C
4B
4B
4E
4F
4F
4H
4K
4I
4G
4G
4H

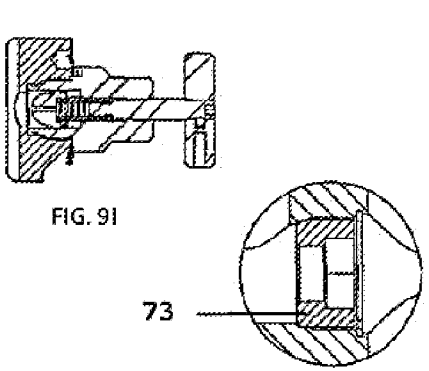
FIG. 9H
FIG. 9I
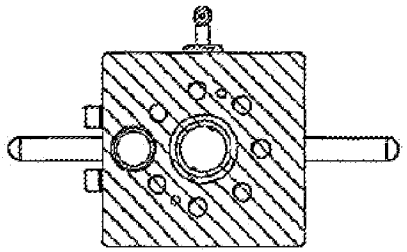
FIG. 9G
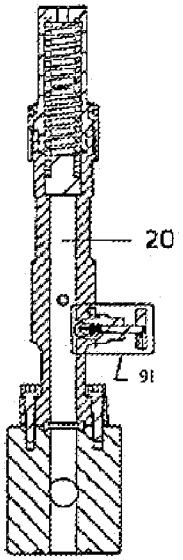
FIG. 9C
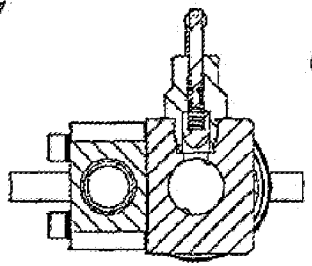
FIG. 9F
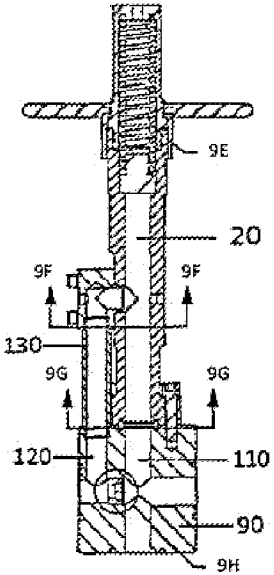
FIG. 9B
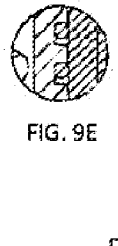
FIG. 9E
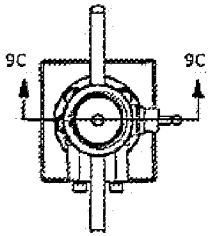
FIG. 9D
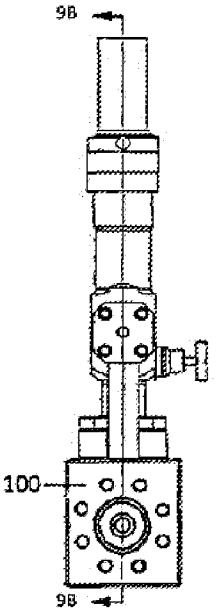
FIG. 9A

COMPACT LUBRICATOR AND HEADER SYSTEM

FIELD OF THE INVENTION

A header with associated lubricator controls fluid handling at the wellhead of an oil and gas well where a plunger/lubricator lift system is deployed, and provides a novel compact lubricator with header which can replace a conventional wellhead flow-tee without modifying or moving other wellhead equipment to accommodate the new lubricator and header replacing the old flow-tee. The header with associated lubricator encloses a conduit with seals in the interfaces between the header and lubricator or between the header and exit attachment means, where the conduit may provide a means of flow restriction through machined geometry or by retaining a reduced diameter component through various means of attachment.

BACKGROUND OF THE INVENTION

Producing oil and gas wells sometimes produce water as well as hydrocarbons from formation. When sufficient, gas flow from formation will remove fluids from the well naturally. But as the formation pressure declines and the gas to liquid ratio decreases, liquid (generally water) will begin to accumulate in the well. When a produced water column in the wellbore reaches a sufficient height, the resulting hydrostatic pressure will exert pressure on the formation which exceeds the formation's pressure preventing gas or produced hydrocarbon flow from the formation up to surface. To overcome this, the water may be removed from the well using one of a number of artificial lift systems. One such system is plunger lift system whereby a plunger deployed in the wellbore drops into the accumulated water column at the bottom of the well where it forms a piston within the cylinder formed of the wellbore's inner walls (typically casing or tubing) which is a movable seal between the formation's production pressure below the piston and the water column above the piston. Gas produced below the plunger forces it and water above it toward the surface, where the water can be removed and the pressure on the formation from the water column can be reduced. This function is performed cyclically, typically without intervention by the operator, and the fluid above the piston is ejected through a lubricator installed on the top of the wellbore, through the lubricator's exit ports to fluid handling equipment at surface.

SUMMARY OF THE INVENTION

A lubricator with compact dimensions is provided by reducing the complexity of conduits from upper and lower lubricator fluid exit ports by adding the header of this invention, which may be fixed directly to the upper and lower exit ports of the lubricator and disposed closely adjacent to the lubricator's body [FIG. 1 and FIG. 2]. The attachment between the lubricator's exit ports and the header's inlet ports may include a seal subassembly ("seal sub"). Where the header's inlet ports attach to the lubricator's exit ports, flow restrictor means may be installed differentially tailor flow rates from the upper and lower ports. The header gathers fluid flow from the upper and lower exit ports of the lubricator providing a conduit to the header's exit port, which is provided with attachment and sealing means for external fluid-handling systems.

The header or lubricator may be provided with servicing access via a removable sealed cover over an access port in the wall of the header or lubricator opposite the seal sub, through which changes to flow restrictor means installed between the lubricator and header may be effected [FIG. 4 and FIG. 5]. The flow restrictor means may be adjustable valve means, which may be manipulated from outside the lubricator and header body, preferably by a handle outside the bodies which may be operably attached via a sealed shaft to a valve in the sub seal or between a lubricator exit port and the header, or may be static flow restrictor orifice plates or similar.

By removing complexity and equipment (valves, short piping conduits at each exit port), and disposing the header directly adjacent to the lubricator, the compact lubricator system can have similar dimensions to a conventional flow-tee which the lubricator and header are designed to replace, for attachment to external gathering equipment without significant (or any) modification of wellhead fittings and equipment. For example, a horizontal distance from the lubricator's bore's center-line to the header's exit port attachment flange may be equivalent to the horizontal distance between a typical slow-tee's conduit's center-line and the flow-tee's flange attachment for external gathering equipment. Similarly, a vertical distance from the bottom face of the bottom flange to the horizontal center-line of the side outlet of the lubricator may be substantially the same as the distance between equivalent points and a conventional flow-tee.

The header may be fabricated by making a lengthwise bore through a solid part, sealing the bore's end, and intercepting the bore with three perpendicular (to the bore) similarly bored ports: one to mate with a lubricator's upper exit port, a second to mate with the lubricator's lower exit port, and a third, opposite to the first two to provide an exit port from the header. Appropriate fittings or seal subs are added to each port to mate with the lubricator and with external fluid handling equipment. Those fittings may also include flow restrictor means (such as plate with orifice).

The header in another embodiment may have an intermediate crossblock is installed at the base of the lubricator, and the crossblock provides a fluid conduit in the operable communication with the header, wherein an upper port of the header connects directly to the lubricator's upper exit port, and the open bottom of the header connects to the crossblock; the crossblock provides an exit port to the header from the lubricator, and provides communication from the header's exit; port, through the header and to a flange connection on the crossblock to external fluid handling equipment.

BRIEF DESCRIPTION OF THE DRAWINGS

FIG. 1 is a group of figures showing an embodiment of the header and lubricator.

FIG. 3 is a set of drawings of a lubricator and header assembly of the PRIOR ART.

FIG. 4 is a set of drawings of a lubricator and header assembly of the invention with access plate.

FIG. 9 shows several portrayals of a lubricator of this invention with a cross-block structure.

FIG. 9A is a side elevation of the header and lubricator toward the header exit port.

FIG. 9B is a cutaway or cross-section of the lubricator and header of FIG. 9A along line 9B-9B.

FIG. 9C is a cross-section of the lubricator along the line 9C-9C of FIG. 9D.

FIG. 9D is a top elevation of the lubricator and header.

FIG. 9E is a section view of seals at point 9E of FIG. 9B.

FIG. 9F is a section view of the lubricator along the line 9F-9F of FIG. 9B.

FIG. 9G is a section view of the upper face of the crossblock and the lubricator along the line 9G-9G of FIG. 9B.

FIG. 9H is a section view of a threaded flow resister at point 9H of FIG. 9B.

FIG. 9I is a magnified section view of the catcher assembly at box 9I of FIG. 9C.

DETAILED DESCRIPTION

Figures 1A, 1B, 1C, 1D, 1E, 1F, 1G, 1H, 1J, 1K:
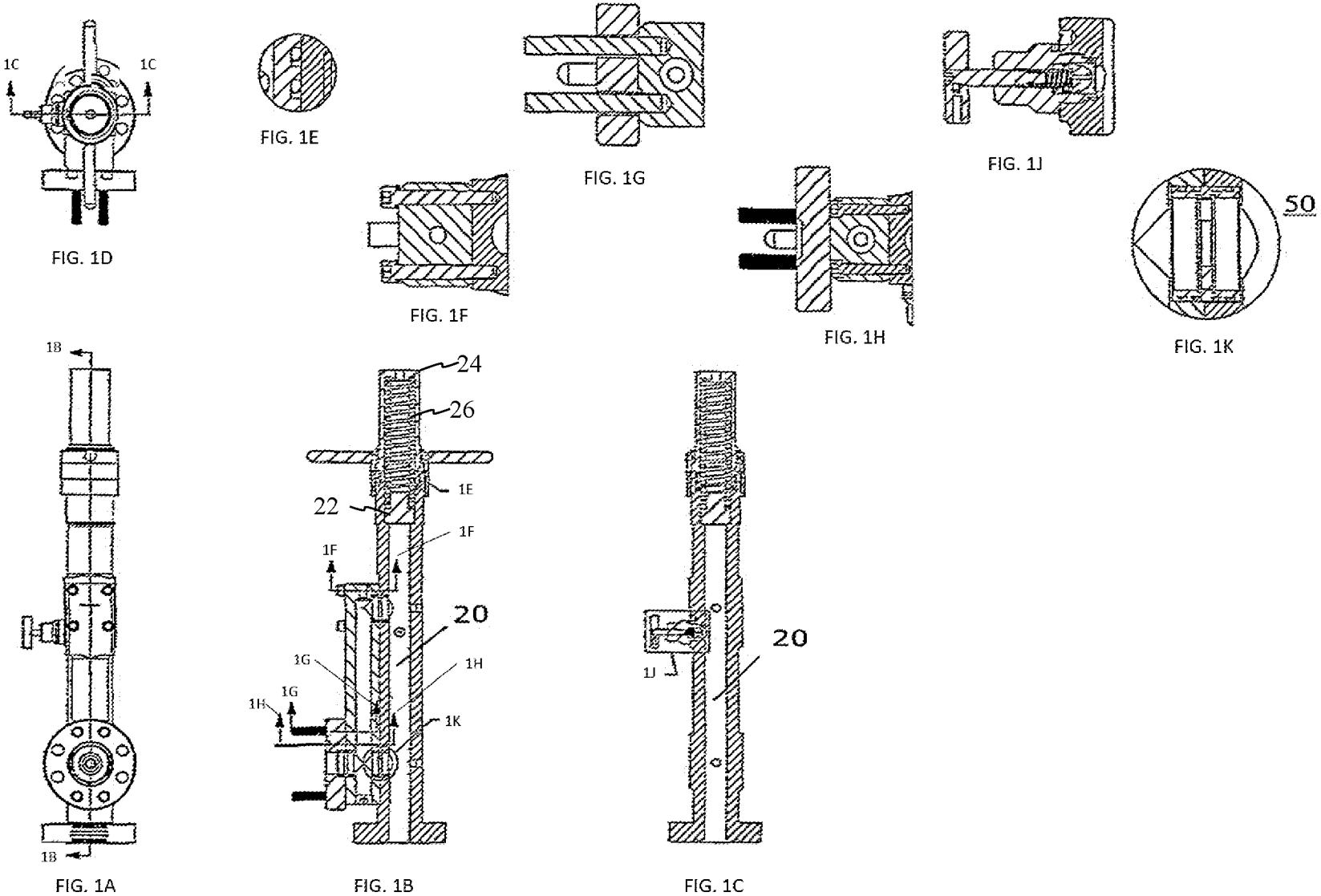
FIG. 1A is a side elevation of the header and lubricator toward the header exit port.
FIG. 1B is a cutaway or cross-section of the lubricator and header of FIG. 1A along line 1B-1B.
FIG. 1C is a cross-section of the lubricator along the line 1C-1C of FIG. 1D.
FIG. 1D is a top elevation of the lubricator and header.
FIG. 1E is a section view of seals at point 1E of FIG. 1B.
FIG. 1F is a cross-section view of the header at line 1F-1F in FIG. 1B.
FIG. 1G is a cross-section view of the header at line 1G-1G in FIG. 1B.
FIG. 1H is a cross-section view of the header at line 1H-1H in FIG. 1B.
FIG. 1J is a cross-section view of the catcher assembly of the lubricator at area 1J of FIG. 1C.
FIG. 1K is a cross-section of a seal subassembly from area 1K of FIG. 1B.
Figure 2:
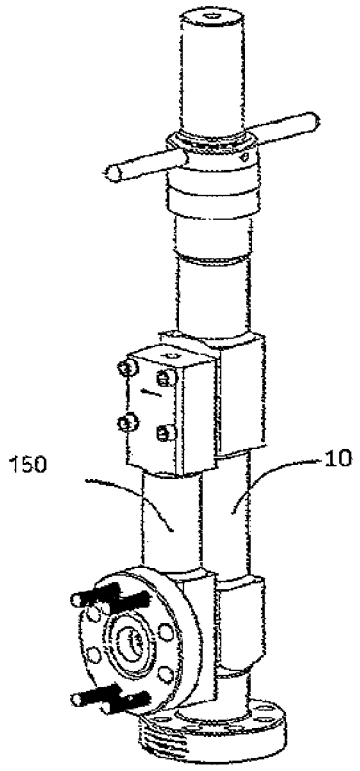
FIG. 2 is a perspective drawing of an oblique elevation of a lubricator and header from the header side of the assembly.
Figure 3H:
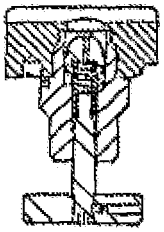
FIG. 3H is a section view of the header at box 3H in FIG. 3C.
Figure 3G:
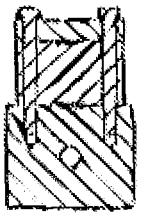
FIG. 3G is a cross-section view of the header at line 3G-3G in FIG. 3B.
Figure 3F:
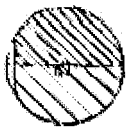
FIG. 3F is a section view at point 3F in FIG. 3B.
Figure 3E:
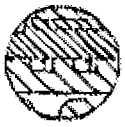
FIG. 3E is a section view of seals at point 3E of FIG. 3B.
Figure 3C:
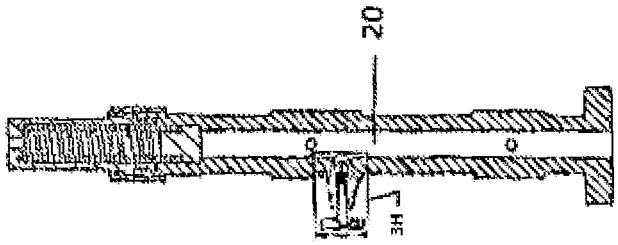
FIG. 3C is a cross-section of the lubricator along the line 3C-3C of FIG. 3D.
Figure 3B:
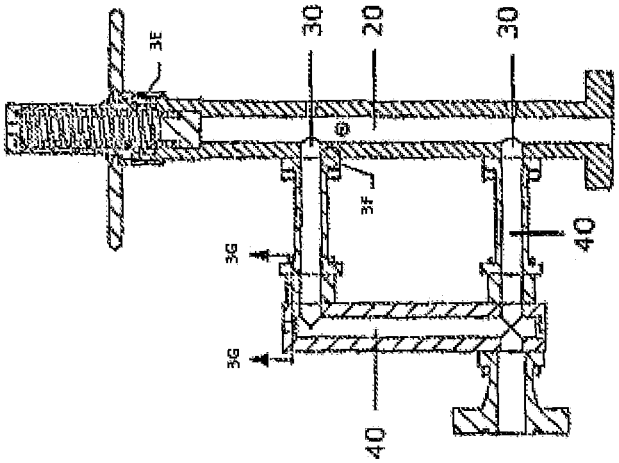
FIG. 3B is a cutaway or cross-section of the lubricator and header of FIG. 3A along line 3B-3B depicting internal passageways.
Figure 3A:
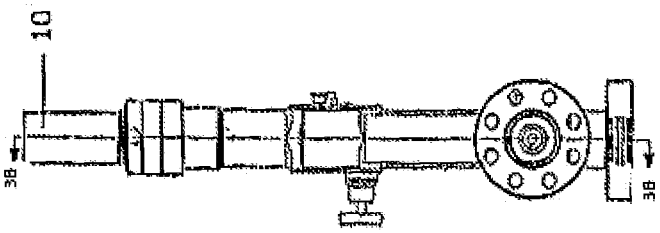
FIG. 3A is a side elevation of a header and lubricator toward a header exit port.
Figure 3D:
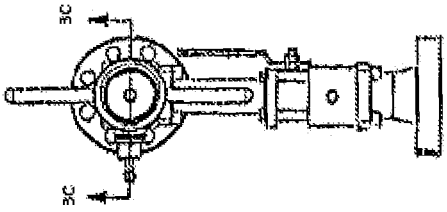
FIG. 3D is a top elevation of the lubricator and header.
Figures 4A, 4B, 4C, 4D, 4E, 4F, 4G, 4H, 4I, 4J, 4K:
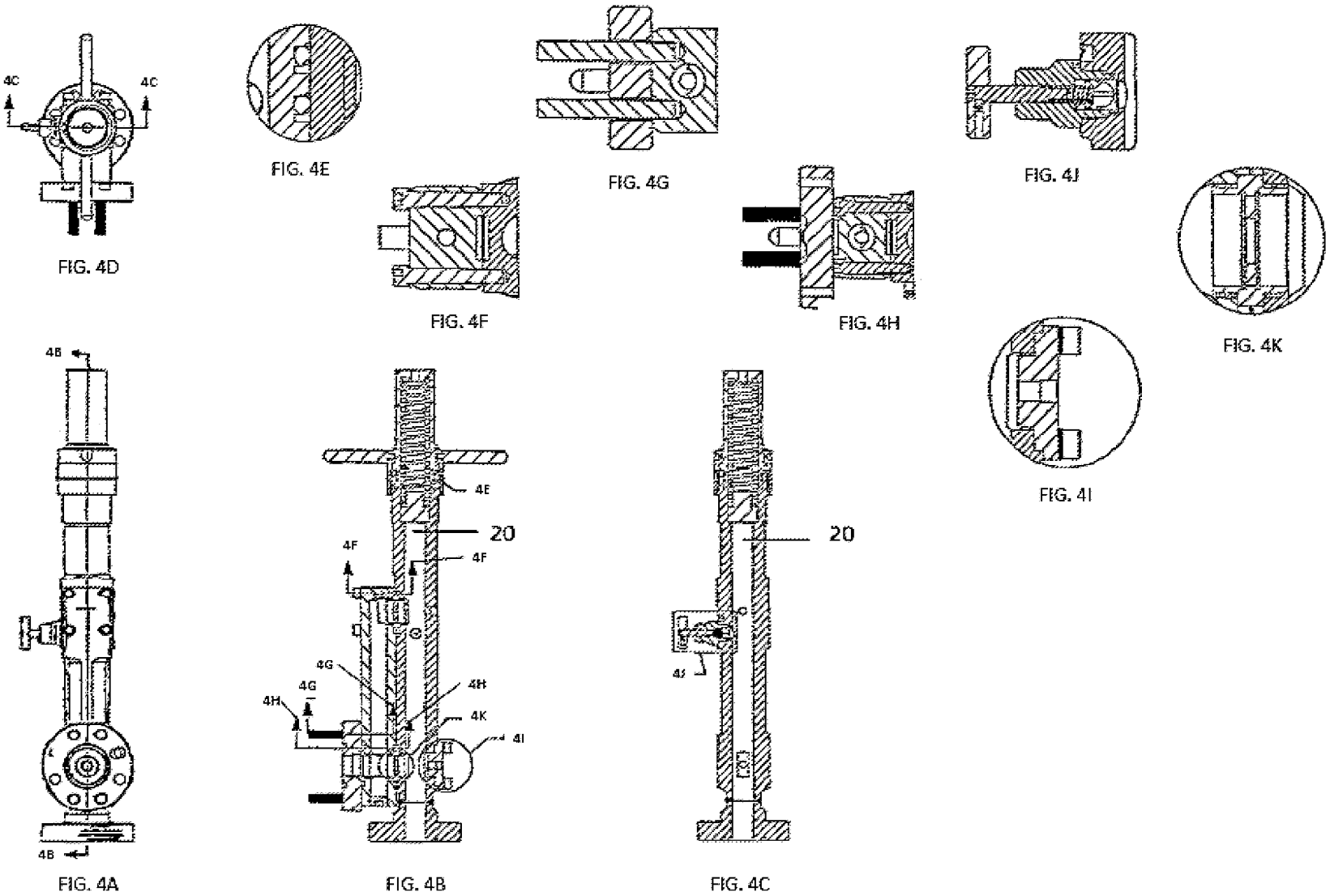
FIG. 4A is a side elevation of the header and lubricator toward the header exit port.
FIG. 4B is a cutaway or cross-section of the lubricator and header of FIG. 4A along line 4B-4B.
FIG. 4C is a cross-section of the lubricator along the line 4C-4C of FIG. 4D.
FIG. 4D is a top elevation of the lubricator and header.
FIG. 4E is a section view of seals at point 4E of FIG. 4B.
FIG. 4F is a cross-section view of the header at line 4F-4F in FIG. 4B.
FIG. 4G is a cross-section view of the header at line 4G-4G in FIG. 4B.
FIG. 4H is a cross-section view of the header at line 4H-4H in FIG. 4B.
FIG. 4I is a cross-section view of the access plate at area 4I of FIG. 4B.
FIG. 4J is a cross-section view of the catcher assembly of the lubricator at area 4J of FIG. 4C.
FIG. 4K is a cross-section of a seal subassembly from area 4K of FIG. 4B.
Figure 5:
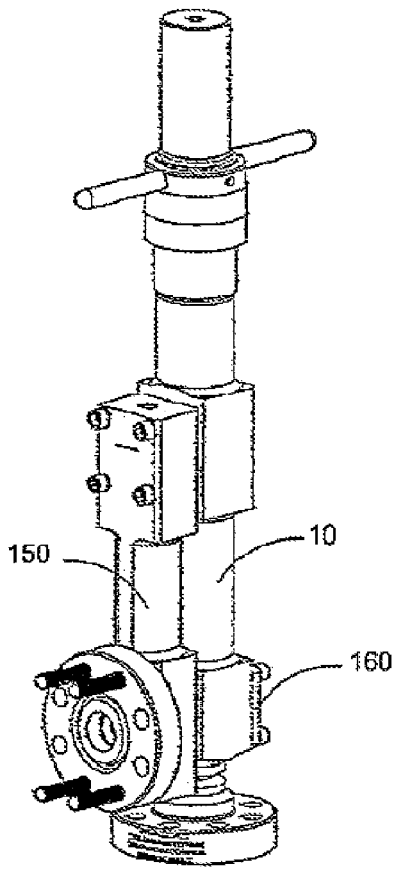
FIG. 5 is a perspective drawing from a side of the header and lubricator assembly of the invention showing an access plate and the exit port of the header.
Figure 6D:
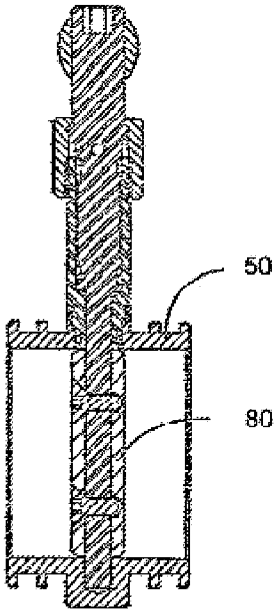
FIG. 6 is 4 sub-figures of an externally controllable valve included in a seal sub of the invention, FIG. 6A showing the valve body closed from an oblique angle, FIG. 6B showing it open from the same angle, FIG. 6C showing the valve closed from a direct perspective into the seal sub, and FIG. 6D showing a cross-section at line 6D-6D of FIG. 6C.
Figure 6C:
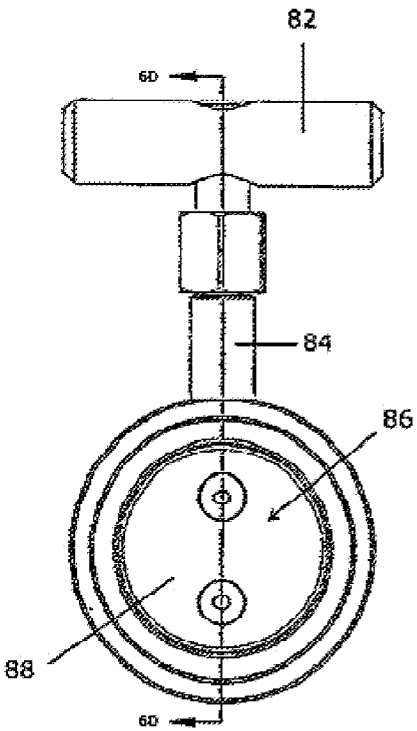
Figure 6B:
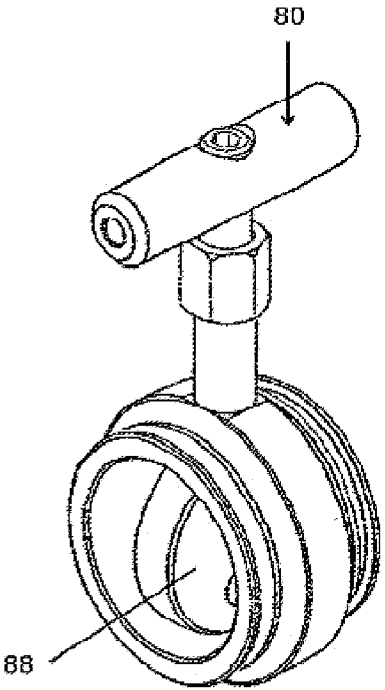
Figure 6A:
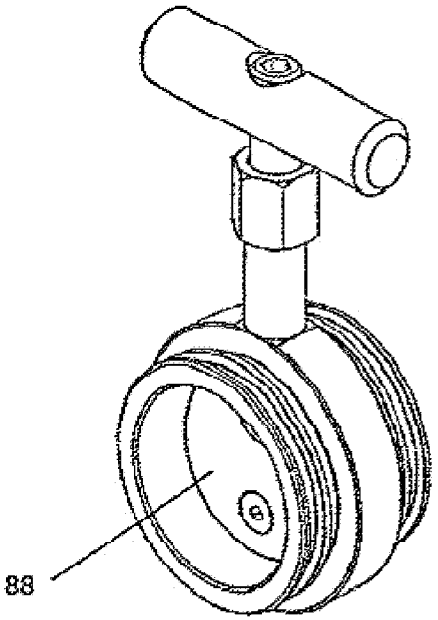
Figure 7D:
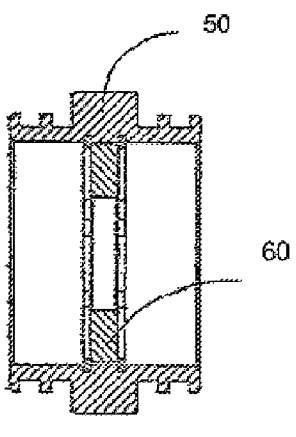
FIG. 7 is a group of 4 sub-figures of a seal sub with orifice plate held against a détente in the seal sub (a spring clip in a groove) by a spring clip in another groove in the inner surface of the seal sub's bore.
FIG. 7A from an oblique angle, FIG. 7B from a side of the seal sub, FIG. 7C directly into the bore of a seal sub, and FIG. 7D a cutaway at line 7D-7D of FIG. 7C.
Figure 7C:
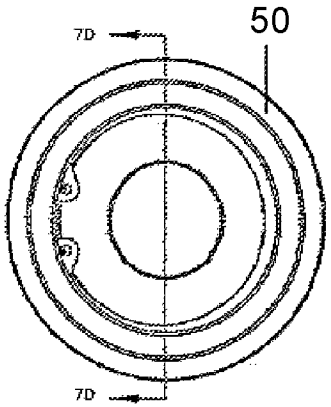
Figure 7B:
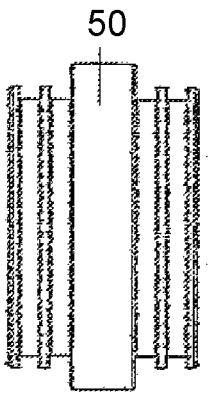
Figure 7A:
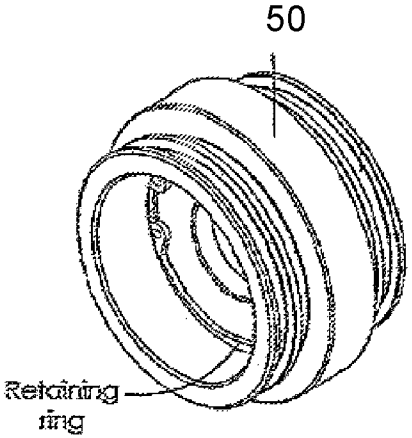
Figure 8D:
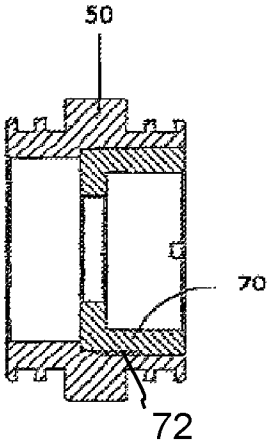
FIG. 8 shows a threaded insert (FIG. 8B) for threaded engagement with mating threads in the interior bore of a seal sub (FIG. 8A and FIG. 8D), the threaded insert having a flow-restricted internal bore of smaller diameter than the seal sub.
FIG. 8C is an end-view of the seal sub with insert mounted.
Figure 8C:
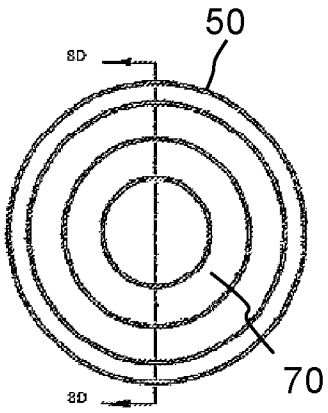
Figure 8B:
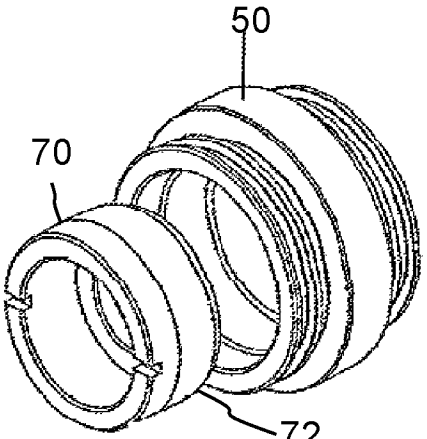
Figure 8A:
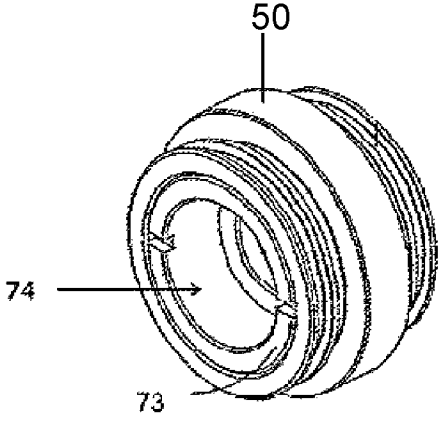

The invention is of a header 150 for a lubricator 10, or the assembly of lubricator and header, the header 150 being in sealed attachment directly and without intermediary extension parts to upper and lower exit ports of the lubricator 10, the header 150 disposed closely adjacent to the lubricator's 10 body, the header 150 providing fluid communication between the lubricator's inner bore 20 through the lubricator's exit ports into internal passageways 40 within the header 150 at the sealed attachments with the exit ports, and through the header's internal passageways through the header's body to an exit port of the header. The header 150 is provided with attachment means to provide fluid communication from the exit port of the lubricator 10 through to the header 150 to external fluid handling equipment. The attachment means may include a seal sub. The lubricator 10 includes an upper lubricator assembly including an anvil 22, spring cap 24, and spring 26.

The header 150 may be provided with flow restriction means installed between at least one of the lubricator's exit ports and the header 150 to tailor relative flow rates from the upper and lower exit ports of the lubricator 10.

The attachment between the lubricator's exit ports and the header's inlet ports may include a seal subassembly ("seal sub") 50. The seal sub may take several forms, and examples are included in FIGS. 1 and 1K, 4 and 4K, 6, 7 and 8.

Where the header's inlet ports attach to the lubricator's exit ports 30, flow restrictor means may be installed, preferably within a seal sub 50, to differentially tailor flow rates from the upper and lower exit ports. The flow restrictor may be of any suitable arrangement, but preferably is an orifice plate 60 attached within the flow path of the interior passage of the sub seal 50. Alternatively, the flow restrictor may be a short tubular-shaped insert 70 with threaded external surface 72, those external threads for mating with threads on the interior wall of a portion of the seal sub, and the insert's inner bore 74 being tailored to restrict fluid flow through the sub seal 50 when installed.

The header 150 or lubricator 10 may be provided with servicing access 160 via a removable sealed cover over an access port in the wall of the header 150 or lubricator 10 opposite a seal sub, through which changes to included flow restrictor means installed between the lubricator 10 and header 150 may be effected. The flow restrictor means may also be adjustable valve means 80 which may be manipulated from outside the lubricator 10 and header body, preferably by a handle 82 outside the bodies operably attached via a sealed shaft 84 to a valve 86 in the sub seal or between a lubricator exit port 30 and the header 150 [FIG. 6].

The header 150 gathers fluid flow from the upper and lower exit ports 30 of the lubricator 10 providing a conduit to the header's exit port, which is provided with attachment and sealing means for external fluid-handling systems.

The flow restriction means in the flow path from a lubricator exit port through the attachment (seal sub) and header 150 may comprise a flow restriction plate with an orifice 60, the plate's orifice choking a fluid flow path from the lubricator 10 into the header 150, or any other suitable flow restriction mechanism.

The attachment means to the upper and lower exit ports of the lubricator 10 enclose a conduit with seals across the interface of the header 150 and lubricator 10, the seals may preferably be incorporated in the seal sub and the interfaces between the lubricator exit port, the seal sub and the header 150.

The assembly provided by the header 150 and lubricator 10 preferably has similar dimension in at least the aspect of the horizontal distance from the lubricator's and a comparative flow-tee's vertical bore centre-line to the header's and the flow-tee's exit port attachment flange, in order to conveniently be installed in place of a conventional flow-tee on a well-head without rearranging nearby and adjacent wellhead equipment or attachments.

The lubricator header can be fabricated from a solid part with two ends by making a lengthwise bore through the part from end to end, sealing the bore's ends, and making perpendicular bores intercepting the lengthwise bore to provide internal passageways in the header 150, with two of the perpendicular bores from one direction on a side of the header 150 to be assembled to the lubricator and the bores spaced to mate with exit ports of the lubricator, and a third intercepting bore to provide an exit port from the header 150; the perpendicular bores being provided with attachment means where they exit the part (header) for attachment to the lubricator and to external fluid collection equipment, the attachment means preferably made to accommodate appropriate sealing means, for example a seal sub at the ports mating with the lubricator 10 and a gasket or similar seal for the attachment to external fluid handling means.

The header 150 may be made from any suitable substance, but preferably from a high strength metal such as a chrome-moly steel alloy or stainless steel alloy.

The attachment means at the lubricator exit port may be a threaded box, single or multi piece bolted clamp over flat or profiled surface with seal, or bolted clamping system enclosing a conduit with seals. The attachment means may also comprise interior features in a lubricator exit port and mating header port to capture and accommodate a seal sub or other sealing means, examples of which are shown in more particularity in FIGS. 1 and 1K, 4 and 4K, 6, 7 and 8.

Examples of an included flow restrictor at or near at least one lubricator exit port may be a removable plate 88 with a restriction orifice that may be of differing diameters, the fixed internal diameter of a seal sub, or an internal surface of the seal sub attachment means to mate with and receive and hold a removable and replaceable flow restrictor. The flow restrictor may be an orifice plate, an insert with smaller internal diameter than the exit port or attachment means, a ball-valve or other conventional valve means, or any suitable flow restrictor; the attachment means for the flow restrictor to the seal sub attachment means or header 150 may be a détente and spring-clip, mating threaded parts, or any suitable flow restrictor attachment mechanism.

The header 150 and lubricator 10 assembly will preferably have similar dimensions in at least the aspect of the horizontal distance from the header 150 with associated lubricator's and a comparative flow-tee's vertical bore centre-line to the header's and the flow-tee's exit port attachment flange, in order to conveniently be installed in place of a conventional flow-tee on a well-head without rearranging nearby and adjacent wellhead equipment or attachments.

The header and lubricator assembly may also preferably have similar dimensions in at least the aspect of the vertical distance from the header 150 with associated lubricator's lower exit port horizontal centerline and a comparative flow-tee's exit port horizontal centerline to the header 150 with associated lubricator's and flow-tee's base or well-head connection flange, in order to conveniently be installed in place of a conventional flow-tee on a well-head without rearranging nearby and adjacent wellhead equipment or attachments.

The header/lubricator assembly preferably will fit in the dimensional space of a pre-existing flow-tee in two directions (three dimensions) so as to be easy to install in place of the flow-tee to provide the functions of a lubricator in an artificial plunger lift system (i.e. plug and play). By having a capability to tailor the respective flow rates of the lubricator's exit ports, the assembly of header with lubricator and flow restriction means can provide multiple flow paths (i.e. upper and lower ports) for plunger operations while staying within the allowed dimensional space of the pre-existing flow-tee.

The attachment between the header 150 and lubricator exit ports provide conduits with seals (or seal subs or interface conduits) to provide a fluid-tight seal between the interface of header/lubricator or header/flowline ports. Conduits with seals, and flow restrictor means or adjustable valves as described may provide a means of restricting flow at a particular desired port (or ports), and in at least some embodiments are replaceable to change the amount of restriction or replaceable when damaged through flow erosion or chemical/well fluid corrosion.

In an embodiment, service access may be provided through ports and sealed cover plates (or similar) to change or service the flow restrictors without disassembling the header 150, sub seal or lubricator from one another.

Restricting flow can be done, for example, through 1) machining a portion of the header 150 conduit bore diameter to a specific size, 2) providing an attachment means such as in a seal sub 50 to retain orifice plates of various hole diameters, 3) via an internal thread in the conduit meant to retain replaceable chokes (sub seal insert with reduced bore). An alternative might be an adjustable valve 86 in a seal sub, with an external handle 82.

As an additional capability, the lubricator 10 could have a lower exit port on the OPPOSITE side of the conventional lubricator geometry with suitable attachments and thereby allowing fluid flow from the casing in situations where production is via included tubulars within the casing (i.e. from a port in communication with the casing/tubing annulus of the wellbore) which could then be tied into fluid communication with the header 150 or the lubricator 10 as well. This could be done within or outside of the header 150 and could replace a flow-CROSS as opposed to the conventional flow-TEE.

Figure 10:
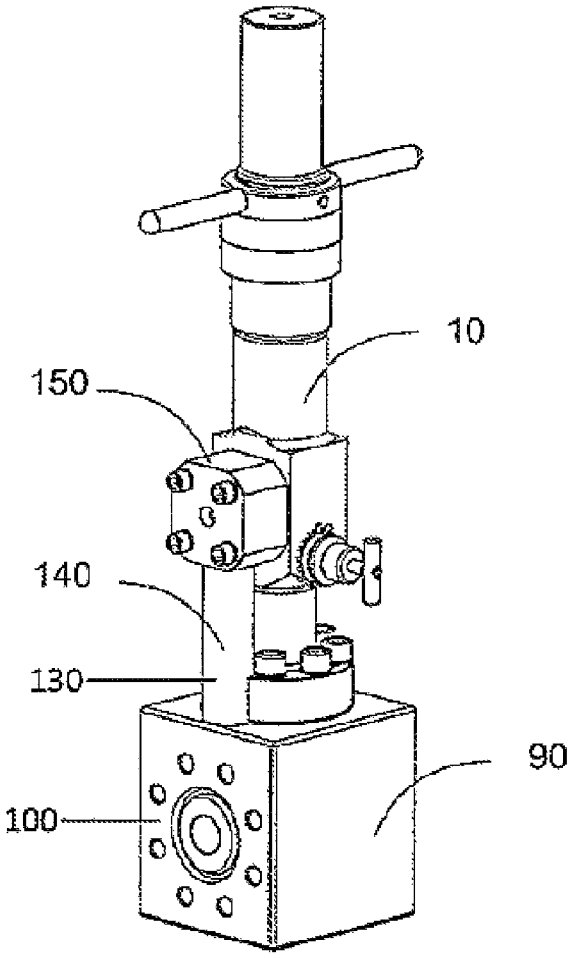
FIG. 10 shows an oblique elevation/perspective drawing of a compact lubricator with cross block.

In the embodiment of FIGS. 9 and 10, a crossblock 9G, 10 ("crossblock") forms the lower end of the lubricator 10, the crossblock's outerface 100 (9A, 10) is configured to act as the flange for the lower exit port 30, with associated sealing aperture, ring, and studs around its included port.

The crossblock 90 has a vertical passageway 120 which receives and seals to the lower portion 130 of the header 150 (or receives the lower end of a tubing 140 part of the header 150, 140, 130, 110 assembly, and this is roughly functionally equivalent to the lower part of the unibody header embodiment described above (without the crossblock). An upper part 110 of the header 150 combined with the tube 140 and crossblock 90 will have the same compact advantage of the preferred embodiment of the invention.

A flow restrictor, shown in FIG. 9H may in an embodiment be installed within the crossblock 90 in the horizontal bore of the crossblock between the lubricator bore and the vertical passageway 120 of the header's tube 140. The flow restrictor may be installed and serviced via an opened end (during servicing) of that horizontal crossblock bore.

A legend is provided here for ease of reference to the reference numbers in the Figures:

| # | Component |
|---|---|
| 10 | lubricator |
| 20 | inner bore |
| 30 | exit port |
| 40 | internal passageways |
| 50 | seal sub |
| 60 | orifice plate |
| 70 | tubular-shaped insert |
| 72 | threaded external surface |
| 73 | threaded conduit |
| 74 | inner bore |
| 80 | adjustable valve means |
| 82 | handle |
| 84 | shaft |
| 86 | valve |
| 88 | removable plate |
| 90 | crossblock |
| 100 | outerface |
| 110 | upper portion of header |
| 120 | vertical passageway |
| 130 | lower portion of header |
| 140 | tube |
| 150 | header |
| 160 | servicing access |

What is claimed is:

1. A plunger lift lubricator assembly comprising a lubricator having an integrated header, wherein:

(a) the lubricator comprises (i) a lubricator body, being entirely vertical along a first vertical axis, and having a lower end comprising a wellhead attachment flange, and defining an entirely vertical longitudinal inner bore, which extends along the first vertical axis and being in fluid communication with an upper exit port and a lower exit port, and, said inner bore configured to receive a plunger travelling upwards into the lubricator through the lower end, and (ii) an upper lubricator assembly comprising an anvil, a removable spring cap, and a spring;

(b) a header, being entirely vertical along a second vertical axis, and attached directly to the lubricator body, in a position immediately adjacent and parallel to the lubricator body, the header defining an entirely vertical longitudinal bore, which extends along the second vertical axis and being in fluid communication with the lubricator inner bore through both the lubricator upper exit port and the lubricator lower exit port, and defining a header exit port configured for coupling with external fluid handling equipment, wherein the first and second vertical axis are parallel to each other.

2. The plunger lift lubricator assembly of claim 1, further comprising a flow restrictor installed between either or both of the lubricator upper and lower exit ports and the header.

3. The plunger lift lubricator assembly of claim 2, wherein the flow restrictor comprises a flow restriction plate with an orifice which chokes a fluid flow path from the lubricator into the header.

4. The plunger lift lubricator assembly of claim 2 wherein the flow restrictor comprises a seal sub having a fixed internal diameter, or a seal sub having a removeable and replaceable orifice plate, an insert having an inside diameter smaller than the lubricator exit port, or a seal sub valve.

5. The plunger lift lubricator assembly of claim 4, wherein the seal sub valve comprises a ball valve.

6. The apparatus of claim 1, configured to replace a conventional flow-tee having a horizontal dimension from a vertical centerline to a flange for connecting to external fluid handling equipment, the apparatus having the same horizontal dimension.

7. A plunger lift lubricator assembly comprising a lubricator having an integrated crossblock and header, wherein:

(a) the crossblock is configured to attach to a wellhead, the crossblock having a vertical internal bore with an inlet and an upper lubricator port, a horizontal bore connected to the vertical bore and having an exit port, and a vertical passageway connecting the horizontal bore to a header port;

(b) a lubricator directly connected to the crossblock and comprising (i) a lubricator body, being entirely vertical along a first vertical axis, and defining an entirely vertical longitudinal inner bore, which extends along the first vertical axis and being in fluid communication with an upper exit port and the crossblock upper lubricator port, said inner bore configured to receive a plunger travelling upwards into the lubricator through the crossblock vertical bore, and (ii) an upper lubricator assembly comprising an anvil, a removable spring cap, and a spring;

(c) a header, being entirely vertical along a second vertical axis, and attached directly to both the lubricator body and the crossblock, adjacent to the lubricator body, the header defining a longitudinal bore which extends along the second vertical axis and being and in fluid communication with the lubricator upper exit port and the crossblock header port, wherein the first and second vertical axis are parallel to each other.

8. The plunger lift lubricator assembly of claim 7, further comprising a flow restrictor installed in the crossblock horizontal bore, between the crossblock vertical internal bore and the crossblock vertical passageway.

9. The plunger lift lubricator assembly of claim 8, wherein the flow restrictor comprises a flow restriction plate with an orifice which chokes a fluid flow path through the horizontal bore.

10. The plunger lift lubricator assembly of claim 8 wherein the flow restrictor comprises a seal sub having a fixed internal diameter, or a seal sub having a removeable and replaceable orifice plate, an insert having an inside diameter smaller than the horizontal bore, or a seal sub valve.

11. The plunger lift lubricator assembly of claim 10, wherein the seal sub valve comprises a ball valve.

12. The plunger lift lubricator assembly of claim 7, configured to replace a conventional flow-cross having a horizontal dimension from a vertical centerline to a flange for connecting to external fluid handling equipment, the lubricator assembly having the same horizontal dimension.

13. A method of replacing a conventional flow-tee or a conventional flow-cross, comprising a step of installing a plunger lift lubricator assembly of claim 1 as a direct replacement of the conventional flow-tee, or a plunger lift lubricator assembly of claim 7 as a direct replacement of the conventional flow-cross.

* * * * *